US009039232B2

(12) United States Patent
Cuda et al.

(10) Patent No.: US 9,039,232 B2
(45) Date of Patent: May 26, 2015

(54) UNDERWATER LED LIGHTS

(71) Applicant: WET, Sun Valley, CA (US)

(72) Inventors: Tom Cuda, Tujunga, CA (US); Graham Baskett, Sun Valley, CA (US); Donald Lariviere, Glendale, CA (US); Boris Karpichev, Glendale, CA (US); Mark W. Fuller, Studio City, CA (US); John Canavan, Burbank, CA (US); Scott Winslow, Tujunga, CA (US); Antonio Layon, North Hollywood, CA (US)

(73) Assignee: WET, Sun Valley, CA (US)

( * ) Notice: Subject to any disclaimer, the term of this patent is extended or adjusted under 35 U.S.C. 154(b) by 0 days.

(21) Appl. No.: 13/728,781

(22) Filed: Dec. 27, 2012

(65) Prior Publication Data

US 2013/0170212 A1 Jul. 4, 2013

Related U.S. Application Data

(60) Provisional application No. 61/582,019, filed on Dec. 30, 2011, provisional application No. 61/586,051, filed on Jan. 12, 2012, provisional application No. 61/683,128, filed on Aug. 14, 2012.

(51) Int. Cl.
*F21V 21/00* (2006.01)
*F21S 4/00* (2006.01)
(Continued)

(52) U.S. Cl.
CPC . *F21V 29/00* (2013.01); *F21V 5/00* (2013.01); *F21V 29/006* (2013.01); *F21V 29/20* (2013.01); *F21V 29/2225* (2013.01); *F21V 29/2243* (2013.01); *F21V 29/2293* (2013.01);
(Continued)

(58) Field of Classification Search
CPC ..... F21V 29/00; F21V 5/00; F21V 29/006; F21V 29/20; F21V 29/2225; F21V 29/2243; F21V 15/011; F21V 29/246; F21V 29/30; F21V 21/40; F21V 23/009; F21V 29/2293; F21Y 2113/00; F21Y 2101/02
USPC ..... 362/249.02, 373, 294, 267, 477, 436, 362/92, 375; 313/35, 36, 44, 45
See application file for complete search history.

(56) References Cited

U.S. PATENT DOCUMENTS 5,802,087 A 9/1998 Takaichi
7,125,146 B2 10/2006 Willis et al.
(Continued)

OTHER PUBLICATIONS

"International Search Report and Written Opinion of the International Searching Authority Dated Apr. 12, 2013; International Application No. PCT/US2012/072179", (Apr. 12, 2013).
PCT, International Preliminary Report on Patentability, Dec. 2, 2013, 12 pages.

*Primary Examiner* — Anh Mai
*Assistant Examiner* — Glenn Zimmerman
(74) *Attorney, Agent, or Firm* — Maceiko IP

(57) ABSTRACT

Underwater LED lights with enhanced cooling to allow the use of substantial numbers of high power LEDs. In all embodiments, the majority of the heat given off by the LEDs is transferred to the housing of the underwater light by heat transfer techniques other than by convection of the air or other gases within the enclosure, providing direct heat conveyance from the LEDs to or through the light enclosure walls, by conduction through a thermal conductor or by or as augmented by heat pipes to the inside wall of the enclosure or through the wall of the enclosure to the water. Various embodiments are disclosed.

14 Claims, 22 Drawing Sheets

(51) Int. Cl.

| | |
|---|---|
| ***F21V 29/00*** | (2006.01) |
| ***F21V 5/00*** | (2006.01) |
| ***F21V 15/01*** | (2006.01) |
| *F21V 21/40* | (2006.01) |
| *F21V 23/00* | (2006.01) |
| *F21Y 101/02* | (2006.01) |
| *F21Y 113/00* | (2006.01) |

(52) U.S. Cl.

CPC ..... *F21V29/246* (2013.01); *F21V 29/30* (2013.01); *F21V 15/011* (2013.01); *F21V 21/40* (2013.01); *F21V 23/009* (2013.01); *F21Y 2101/02* (2013.01); *F21Y 2113/00* (2013.01)

(56) References Cited

U.S. PATENT DOCUMENTS

| | | | | |
|---|---|---|---|---|
| RE39,856 | E | 9/2007 | Ruthenberg | |
| 2002/0125804 | A1 | 9/2002 | McGuire et al. | |
| 2007/0159833 | A1 | 7/2007 | Netzel, Sr. et al. | |
| 2007/0279921 | A1 | 12/2007 | Alexander et al. | |
| 2007/0285926 | A1 | 12/2007 | Maxik | |
| 2008/0048566 | A1 | 2/2008 | Lin | |
| 2008/0205062 | A1 | 8/2008 | Dahm et al. | |
| 2008/0253140 | A1* | 10/2008 | Fleischmann et al. | 362/487 |
| 2009/0027900 | A1* | 1/2009 | Janos et al. | 362/373 |
| 2010/0165632 | A1* | 7/2010 | Liang | 362/294 |
| 2011/0192571 | A1* | 8/2011 | Shen | 165/104.19 |
| 2011/0267834 | A1 | 11/2011 | Potucek et al. | |

* cited by examiner

UNDERWATER LED LIGHTS

CROSS-REFERENCE TO RELATED APPLICATIONS

This application claims the benefit of U.S. Provisional Patent Application No. 61/582,019 filed Dec. 30, 2011, U.S. Provisional Patent Application No. 61/586,051 filed Jan. 12, 2012 and U.S. Provisional Patent Application No. 61/683,128 filed Aug. 14, 2012.

BACKGROUND OF THE INVENTION

1. Field of the Invention

The present invention relates to the field of underwater lighting.

2. Prior Art

The brightness of present LED based underwater lights is limited by the buildup of heat within the light fixture. This heat is generated by the LEDs themselves which, though more efficient than tungsten and many other light sources, still suffer from a less than 100% efficient conversion of input energy to light, the balance turning into heat, primarily at the light emitting diode junction, plus heat from the power supply and related control electronics that operate the LEDs.

Currently, the brightest underwater LED light fixtures are typically about 8 to 20 watts, with a few approaching 60 watts. Attempts to make these fixtures brighter by increasing either the power of the individual LEDs, or the quantity of LEDs, or both, have met with failure because of the increased internal heat within the waterproof housing, which dramatically shortens the operating life span of the LEDs, or causes significant color or output degradation, or destroys them entirely. Even the few fixtures that approach 60 watts do so only by becoming very large in size, to the point of being cumbersome and limited in applicability.

On the other hand, in non-submersible uses such as in theatre stage lights and outdoor concert lights, higher power LED fixtures are available, of the order of several hundred watts or more. This is because these fixtures' housings readily dissipate their internal heat away from the LED junctions by incorporating cooling openings and fans to vigorously draw atmospheric air into, through, and away from the LEDs or their heat sinks. Various additional fins and heat sink housings can also be attached to further the transfer of heat to the atmosphere. The cooling is facilitated by a nearly endless supply of relatively cool air in such applications.

However, none of the foregoing is effective when the entire light assembly has to be sealed inside a container that is submerged under water. In such a case, there is a very small amount of internal air, which rapidly becomes very, very elevated in temperature. The only means available for cooling is for the heat to be transferred from the LEDs to the air via convection or conduction, and from the air to the inner wall of the enclosure, then through the enclosure, and into the water. Some heat may travel by radiation from the LEDs (or power supply, etc.) directly to the inner wall of the enclosure, and then through the wall and out to the water. Still, heat buildup is the largest impediment to obtaining higher power underwater LED lighting. The largest impediment here is getting the heat from the air to the inner wall of the enclosure. The transfer from air to inner wall is very poor, and consequently, the air rises in temperature to the point where insufficient heat can transfer from the LEDs to the air until the LEDs reach a damaging, high temperature.

DETAILED DESCRIPTION OF THE PREFERRED EMBODIMENTS

The exemplary embodiment of the present invention utilizes a commercially available LED lighting fixture manufactured by Elation Professional as their Arena Par Fixture. This lighting fixture is intended for use in non-submersible applications where fan cooling is practical because of the relatively unlimited supply of cooling air. The lighting unit uses 90 3-watt Cree XP-E LEDs, namely, 18 red, 24 green, 24 blue and 24 white LEDs. This allows white lighting as well as controlled mixing of three primary colors to obtain white and/or any mixture of the primary colors, all with intensity control so that substantially any color of any brightness may be achieved under program control. In that regard, the lighting module includes a power supply connection and two communication ports using the DMX-512 protocol so that multiple lighting modules may be daisy chained.

Figure 1:
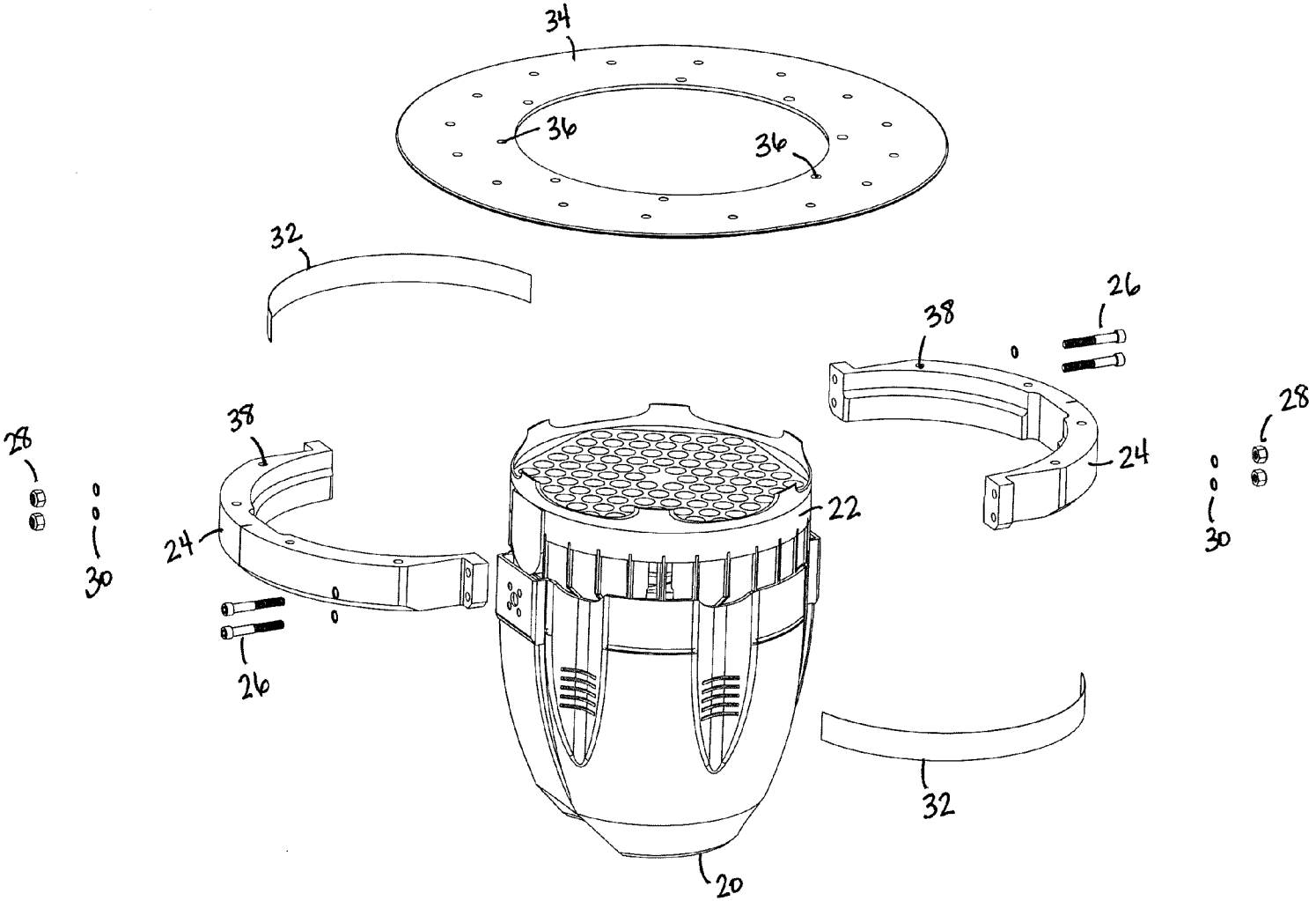
FIG. 1 illustrates an Elation LED lighting module and associated initial assembly of parts of an exemplary embodiment of the present invention.

The Elation lighting module and associated initial assembly of parts of an exemplary embodiment are shown in an exploded view in FIG. 1. The Elation lighting module 20 has a heat sink 22 at the top thereof which is in very good thermal contact with the 90 LEDs in the lighting module. The present invention clamps to the lighting module in such a way as to provide excellent heat conduction to the outside of a waterproof housing, as shall be subsequently described in detail. To clamp tightly to the heat sink 22, a pair of half rings are provided which may be bolted together by bolts 26 using lock washers 30. Half clamps 24 clamp around the heat sink 22 on the lighting module 20 with thermal interface pads 32 therebetween to assure good heat conduction from the heat sink 22 to the half clamps 24. In that regard, the half clamps 24 are preferably fabricated from a high thermal conductivity material, in the exemplary embodiment, aluminum. The half clamps could be clamped directly around the heat sink 22, and to the extent there is good contact therebetween, there will be good heat conduction from the heat sink 22 to the half clamps 24. This is not preferred, however, as one cannot be assured that the contact is good and uniform around the full perimeter of the heat sink, and any gap between the heat sink 22 and the half clamps 24 will have very poor heat transfer characteristics. In particular, heat transfer through that gap would be primarily by the thermal conductivity of the air in that gap, which conductivity is quite low. Because the gap would be quite small, there would be substantially no heat transfer by convection, and of course heat transfer by radiation depends on a very substantial temperature difference between the two surfaces, the very thing that the present invention is trying to substantially eliminate to protect the LEDs and driver circuitry. Of course, rather than the thermal interface pads 32, a thermally conductive paste of other material may be used in this or in alternate embodiments to be described.

After the half clamps 24 are clamped to the heat sink 22 on the lighting module 20 with the thermal interface pads 32 therebetween, a plate or copper heat sink ring 34 bolts to two half clamps 24 by bolts passing through holes 36 in the copper heat sink ring 34 into threaded holes 38 in the half clamps. This assembly provides excellent heat conduction from the heat sink 22 on the lighting module 20 to the copper heat sink ring 34, as the half clamps 24 and thermal interface pads 32 provide a substantial contact area to the heat sink 22, with the half clamps 24 also providing a substantial area of contact to the copper heat sink ring 34. While not shown in FIG. 1, one could also use an appropriately shaped thermal interface pad or a thermally conductive paste of a thermally conductive filler between the half clamps 24 and the copper heat sink ring 34 for the same reasons as herein previously mentioned.

Figure 2:
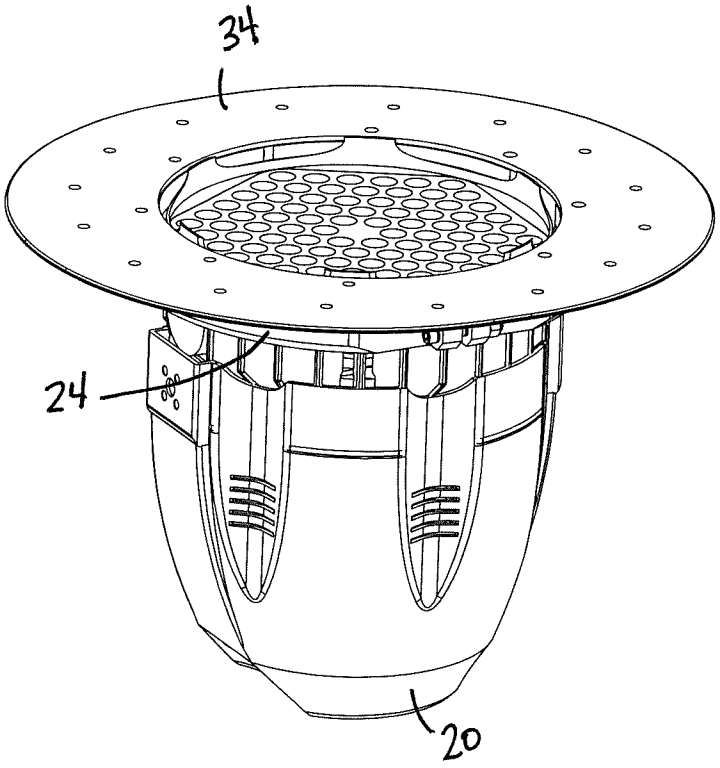
FIG. 2 illustrates the full assembly of the various parts illustrated in FIG. 1.
Figure 3:
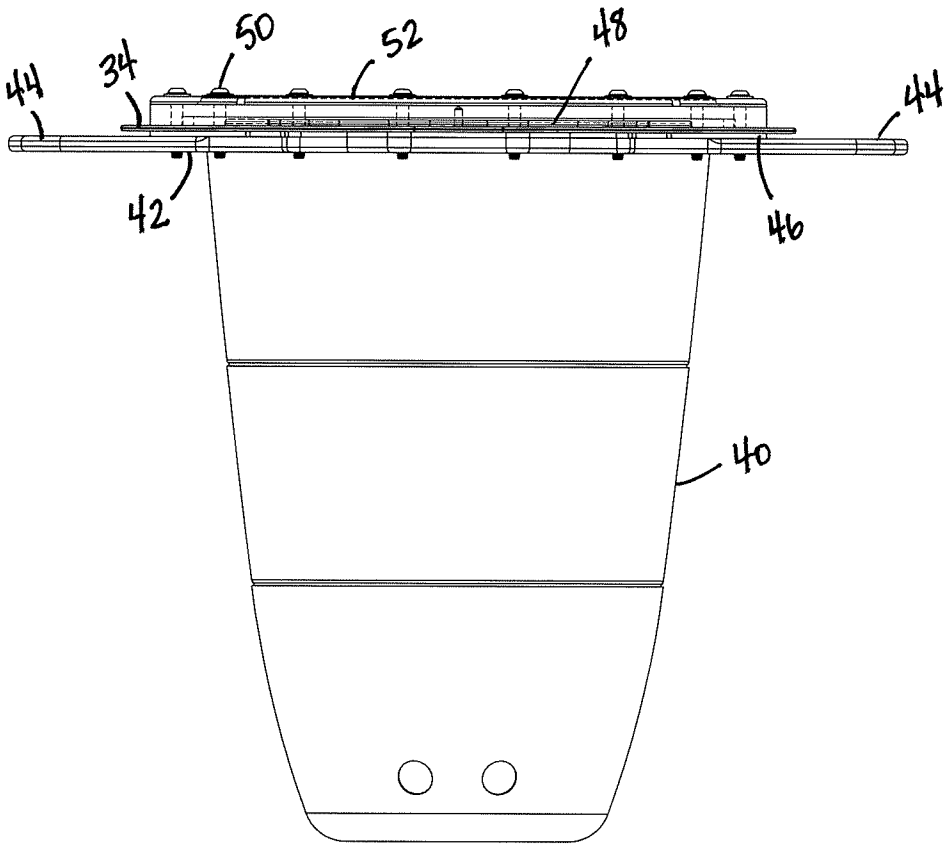
FIG. 3 is an illustration of the side view of a complete LED light in accordance with one embodiment of the present invention.

FIG. 2 illustrates the full assembly of the various parts illustrated in FIG. 1. As may be seen in FIG. 3, the assembly of FIG. 2 fits within a housing 40, preferably of stainless steel, having a flange 42 welded thereto. The flange 42 includes handles 44 thereon, which may also be seen in FIG. 4. The assembly of FIG. 2 fits within the housing 40 with the copper heat sink ring 34 resting on a seal 46. Resting on the copper heat sink ring 34 is another seal (not shown) with lens 48 thereon, with the entire assembly being screwed together using screws 50 through four 90° clamps 52.

Figure 4:
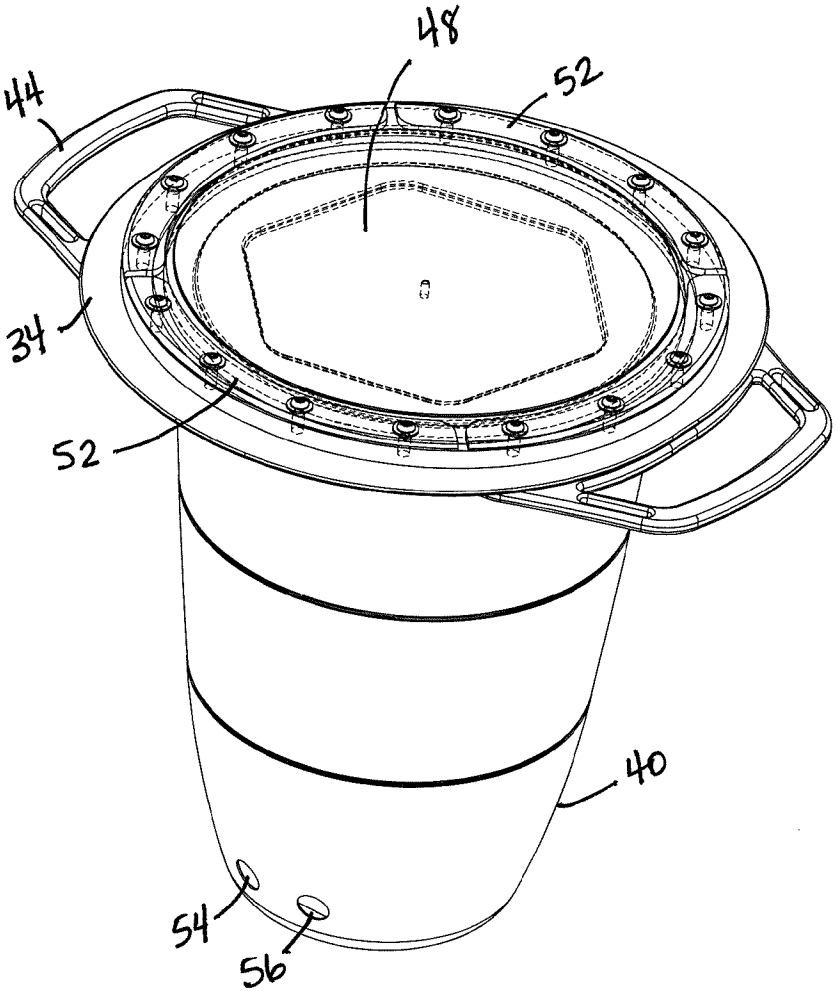
FIG. 4 is a perspective view of the embodiment of FIG. 3.

The finished assembly may be seen in FIG. 4. The entire assembly shown is fully water tight, except for openings 54 and 56 in housing 40, which openings are for a power cord and a communication cable, and which will also be sealed so that the entire assembly is water tight for use as an underwater lighting fixture. In that regard, the copper heat sink ring 34 extends outward somewhat into the water (except in the handle region) to provide a substantial area for conduction of heat to the water, with heated water rising to provide a normal convection type supply of cool water to maintain the entire LED assembly relatively cool to prevent thermal degradation or failure of the LEDs or electronics in the lighting module 20 (FIGS. 1 and 2). Thus a high intensity, fully controllable white and colored underwater lighting fixture is provided using a relatively large number of high powered LEDs to provide a highly versatile yet compact underwater lighting fixture.

The present invention provides the ability to dramatically increase the quantity and/or power and/or both of LEDs in an underwater light fixtures. It also provides the ability to enclose a high power "dry" LED light fixture in an underwater enclosure that is capable of transferring sufficient heat out into the water to allow the LEDs to operate with normal life expectancy and brightness. The present invention also provides the ability to place a high power light engine of any new design in a water tight enclosure, as opposed to enclosing an existing theatrical fixture. The present invention allows the foregoing by directly and physically coupling the heat source to a highly conductive material that is in direct physical contact with the inside of the enclosure and has heat conductive materials such as conductive pastes or pads at the junctures to essentially create a "heat highway" that obviates the need to rely on internal radiation, air conduction and/or air convection. This is accomplished by directly and physically coupling the heat source to a highly conductive material that passes through the walls of the enclosure and out into the surrounding water. It also achieves the foregoing using a limited amount of expensive, heat conducting material, such as copper, and thereby allows the enclosure or housing itself to be substantially built of less costly materials.

Figure 5:
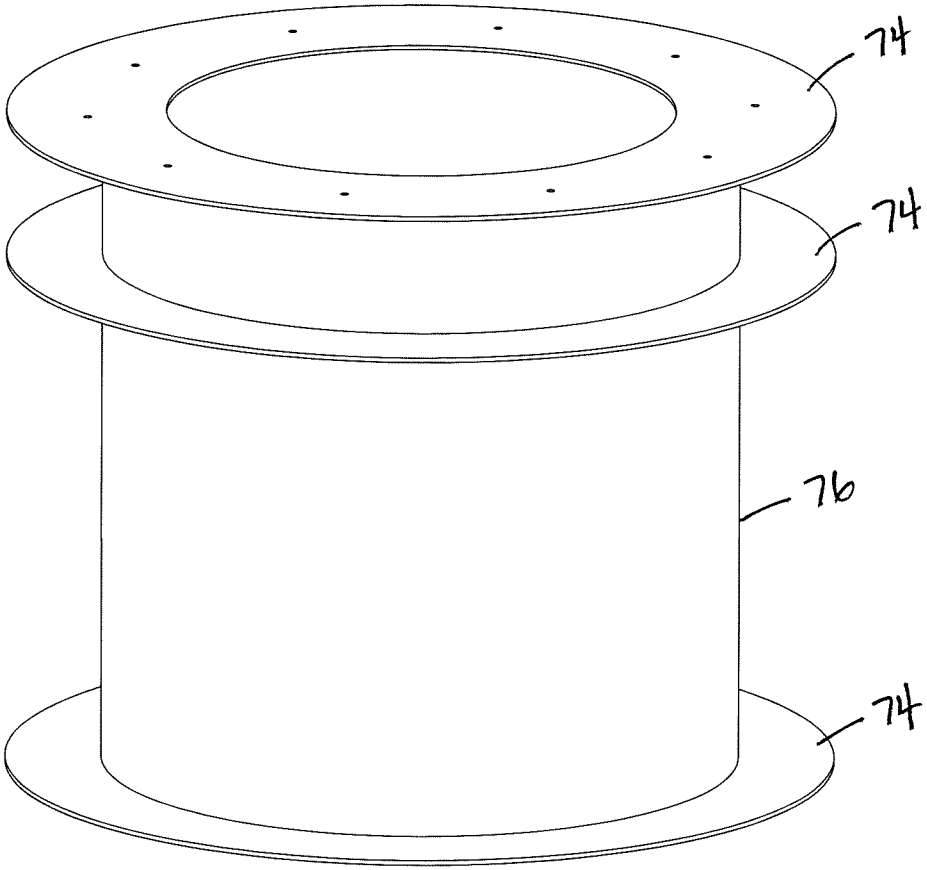
FIG. 5 illustrates another embodiment for cooling for the LED light.
Figure 6:
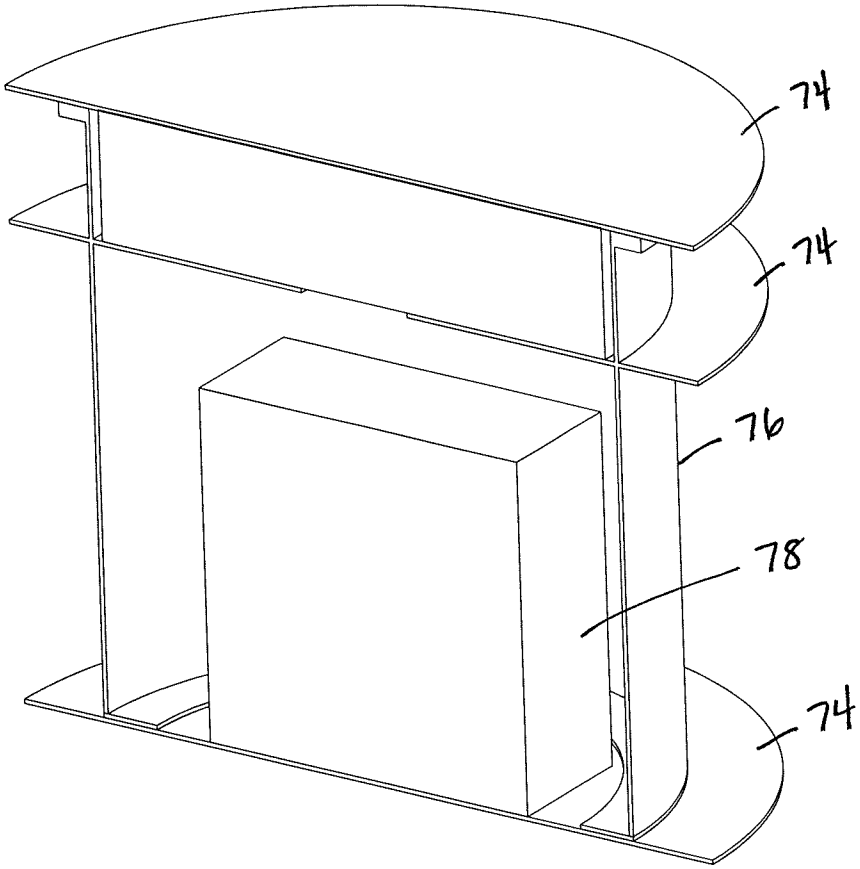
FIG. 6 is a cross section of the embodiment of FIG. 5.

The present invention includes various other ways to cool such a light fixture. By way of example, multiple fins 74 penetrating the housing 76 into the water could be used to transfer heat transferred to the inside of the housing 76 by heat conduction, as illustrated in FIGS. 5 and 6. This would involve fins 74 placed at different cross sections of the housing instead of a single fin. Each fin 74 would penetrate the waterproof enclosure to extend into the water. On the inside of the enclosure each fin would be in contact with heat producing elements such as LED circuit boards or power supplies 78. The enclosure could be completed various ways, such as by using a transparent cover as in the embodiment of FIGS. 1-4. This method would allow more efficient removal of heat than a single fin, as all components that generate heat could have a significant and direct thermally conductive path to the water.

Figure 7:
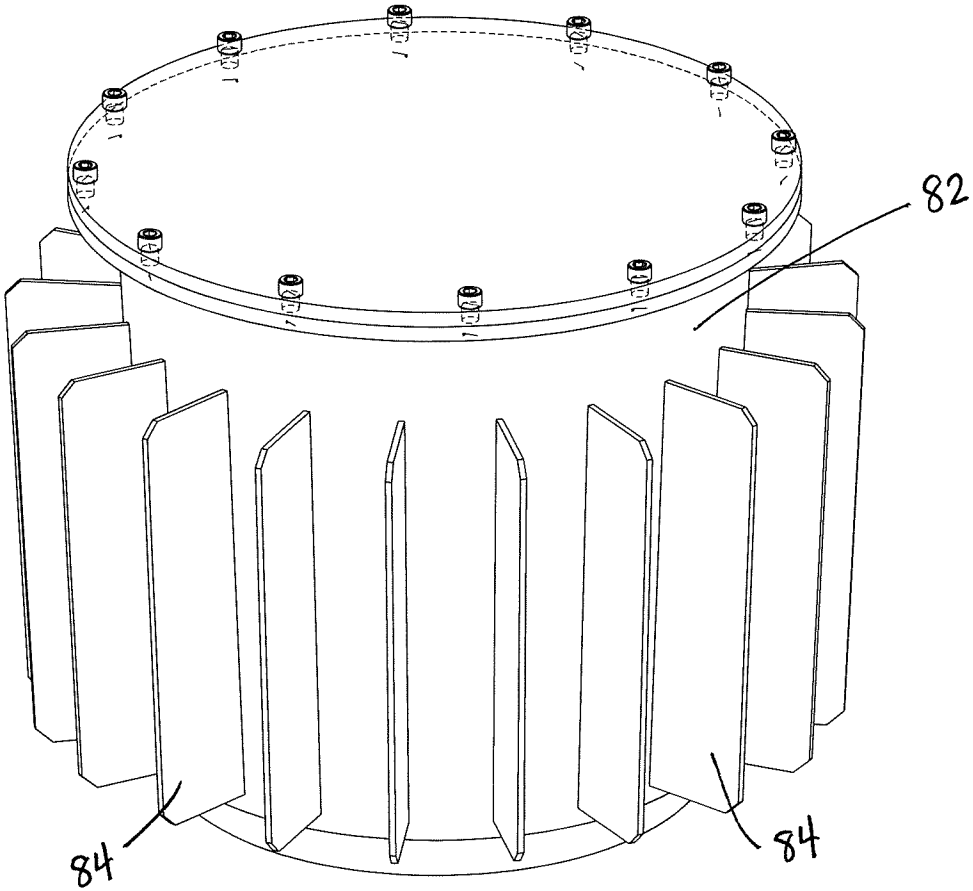
FIG. 7 illustrates another embodiment for cooling the LED light.
Figure 8:
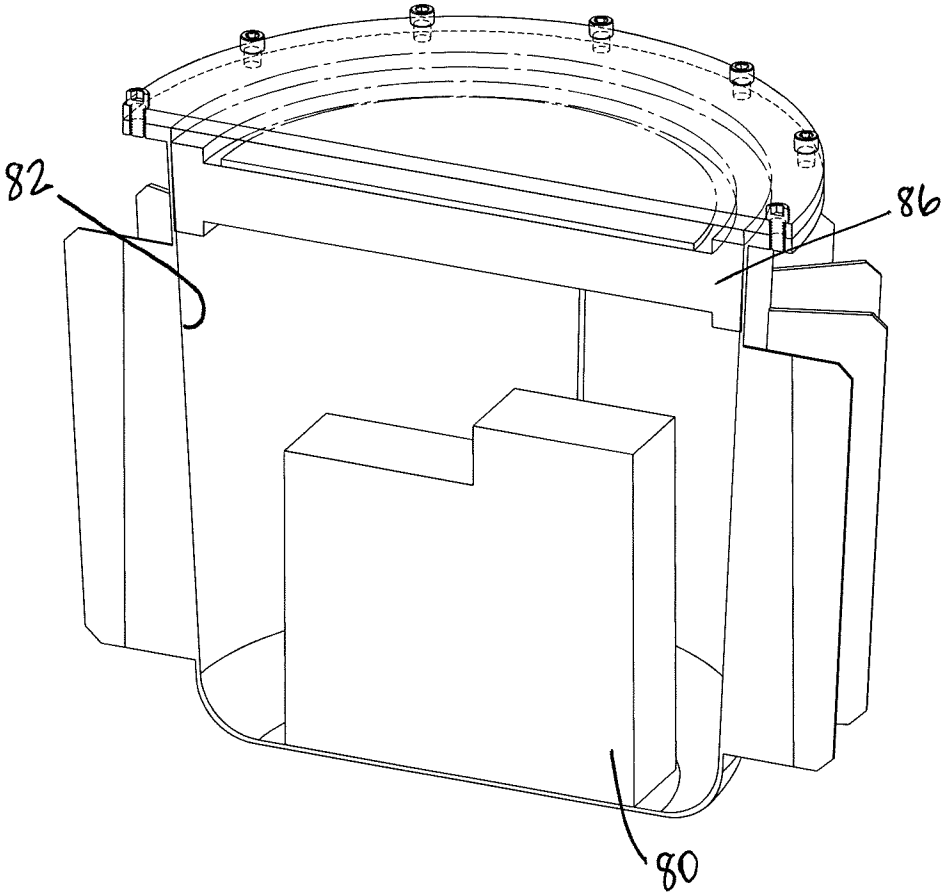
FIG. 8 is a cross section of the embodiment of FIG. 7.

Another method of cooling the light fixture is illustrated in FIGS. 7 and 8. Here a significant conductive heat path from heat producing elements, such as, but not limited to, LED circuit boards and heat conductor 86 at the upper part of the housing 82 and power supplies 80, to the inside wall (bottom in the case of power supplies 80) of the waterproof enclosure, for example a stainless steel or copper enclosure. Heat transferred to the inside wall of a metal, or other type of fairly heat conductive, enclosure 82 (housing) would be conducted through the wall by conduction and into the water by convection past optional vertical fins 84 very quickly. If the heat is transferred onto the inside wall of the enclosure 82 by conduction, then the overall process of transferring heat to the water would operate much more efficiently than current methods of transferring heat to the inside wall of an enclosure mainly by convection (forced or free) between air trapped in the enclosure and the inside wall. This convective path to the inside wall is the main path for heat transfer in current underwater LED lights on the market and represents a significant barrier to heat transfer. This method would eliminate the highly heat transfer resistive convective path.

The conductive path to the inside wall of the enclosure in accordance with embodiments of the invention is realized by significant heat conductive elements in contact with both heat producing elements and the inside wall of the enclosure. For example, a copper plate to which the power supply on which the LEDs are mounted could then be press fit to the inside of the housing. Similarly one or more copper plates could be in contact with the LED circuit board, or could be an extension of it, and then extend to have a significant area pressed into the inside of the waterproof enclosure. Similarly such plates could be bolted, welded, glued, or brazed to the inside of the enclosure; any method that puts them in close contact with the inside wall of the housing without a high heat transfer resistive medium in-between would suffice.

Figure 9:
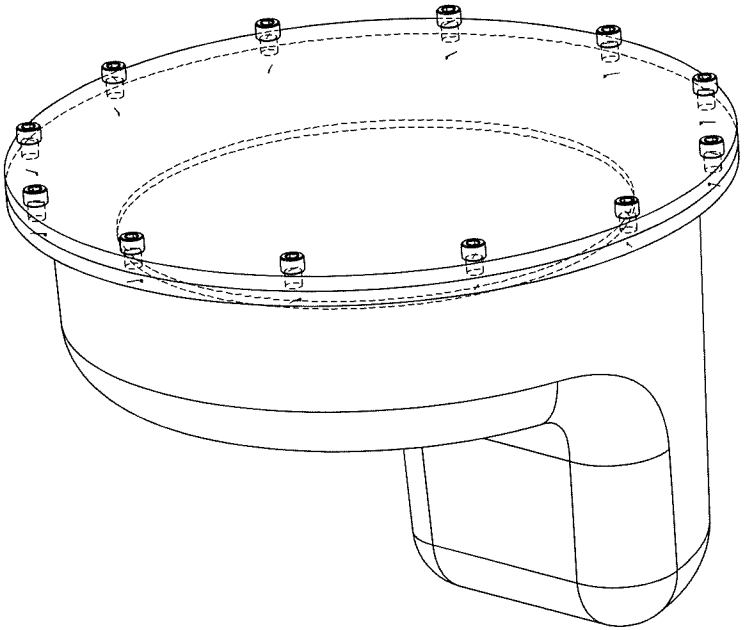
FIG. 9 schematically illustrates another embodiment for cooling of the LED light.
Figure 10:
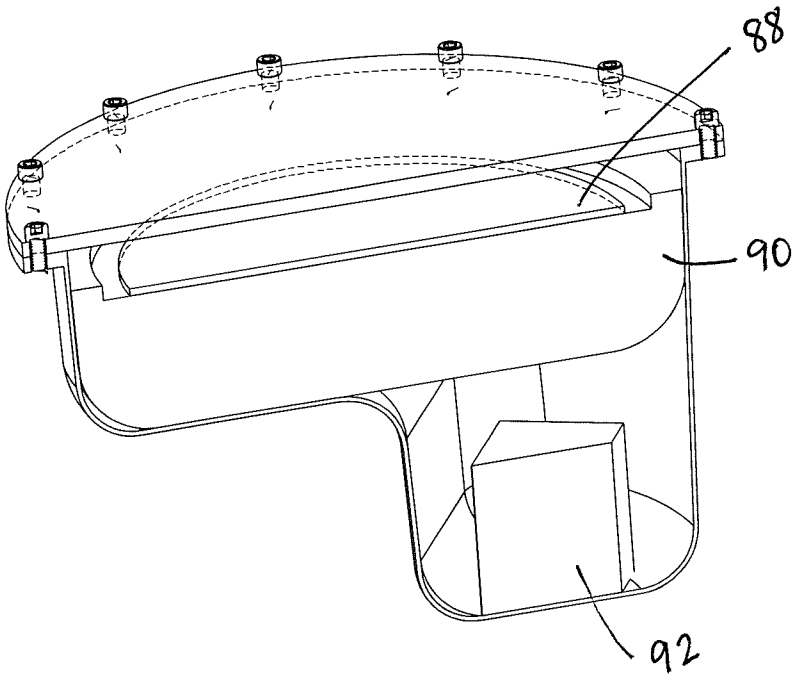
FIG. 10 is a cross section of the embodiment of FIG. 9.

In FIGS. 9 and 10, an embodiment is schematically shown wherein the heat producing LEDs 88 are mounted on a shelf like heat conductor 90, and the power supply 92 is mounted directly against the bottom of the housing 102. Thus the waterproof enclosure could be made with areas on the inside to which heat producing elements could be directly mounted. For example a part of the enclosure forms a shelf on the inside of the housing to which the power supply or LED circuit board attaches. Of course for all these examples of this method, fins on the outside of the enclosure will further increase the heat transfer, if needed.

Figure 11:
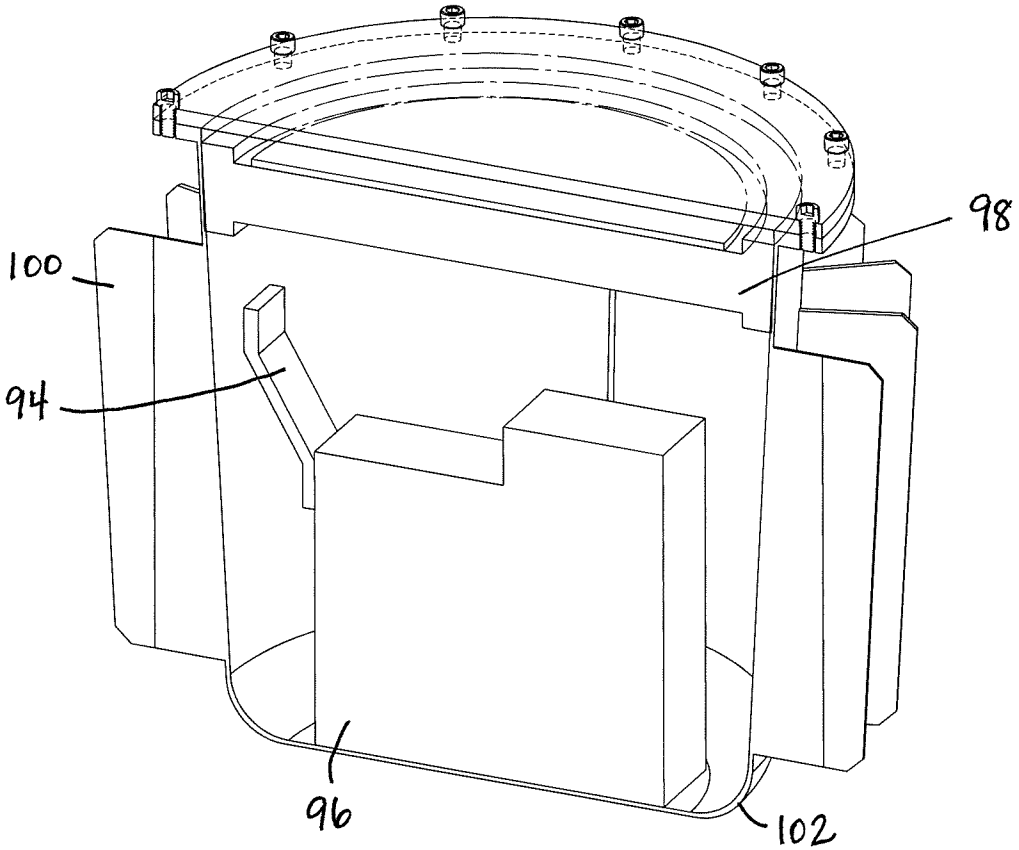
FIG. 11 is a cross section illustrating another embodiment for cooling the LED light of the present invention.

Another method of removing heat from the enclosure is to use some form of heat pipe. Heat pipes utilizing a medium that undergoes a phase change could be utilized to transfer heat away from heat producing elements such as LED circuit boards or power supplies. Such pipes 94 (only one is shown, though multiple heat pipes typically would be used) could transfer heat to the inside wall of the waterproof enclosure (FIG. 11). This would operate similar to the method above, but instead of bringing the heat to the inside wall of the enclosure by conduction it would be brought there by the bulk fluid movement and phase changes of the fluid within the heat pipes. This method of moving heat to the inside wall would be much more efficient than current methods of moving heat to the inside wall by convection of air trapped within the waterproof enclosure. In the embodiment of FIG. 11, the power supply 96 is directly mounted on the bottom of the housing and the LED cluster is directly mounted on the heat conductor element 98 that conducts heat directly to the wall of housing 102. In the embodiment shown, the housing 102 includes fins 100 for additional cooling.

Figure 12:
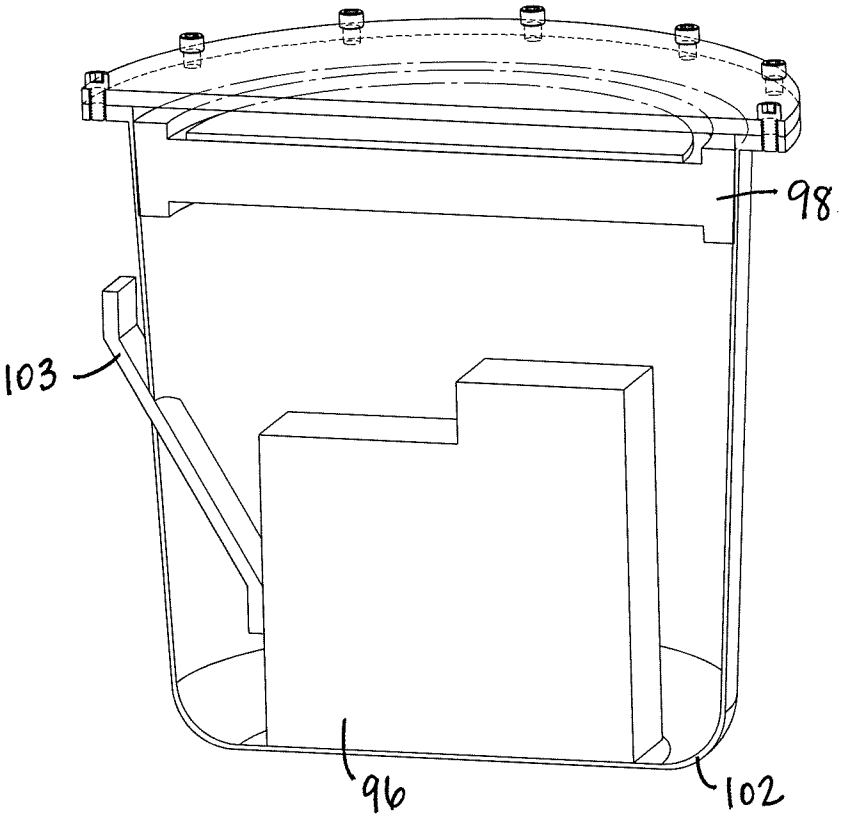
FIG. 12 is a cross section illustrating another embodiment of cooling for the LED light of the present invention.
Figure 13:
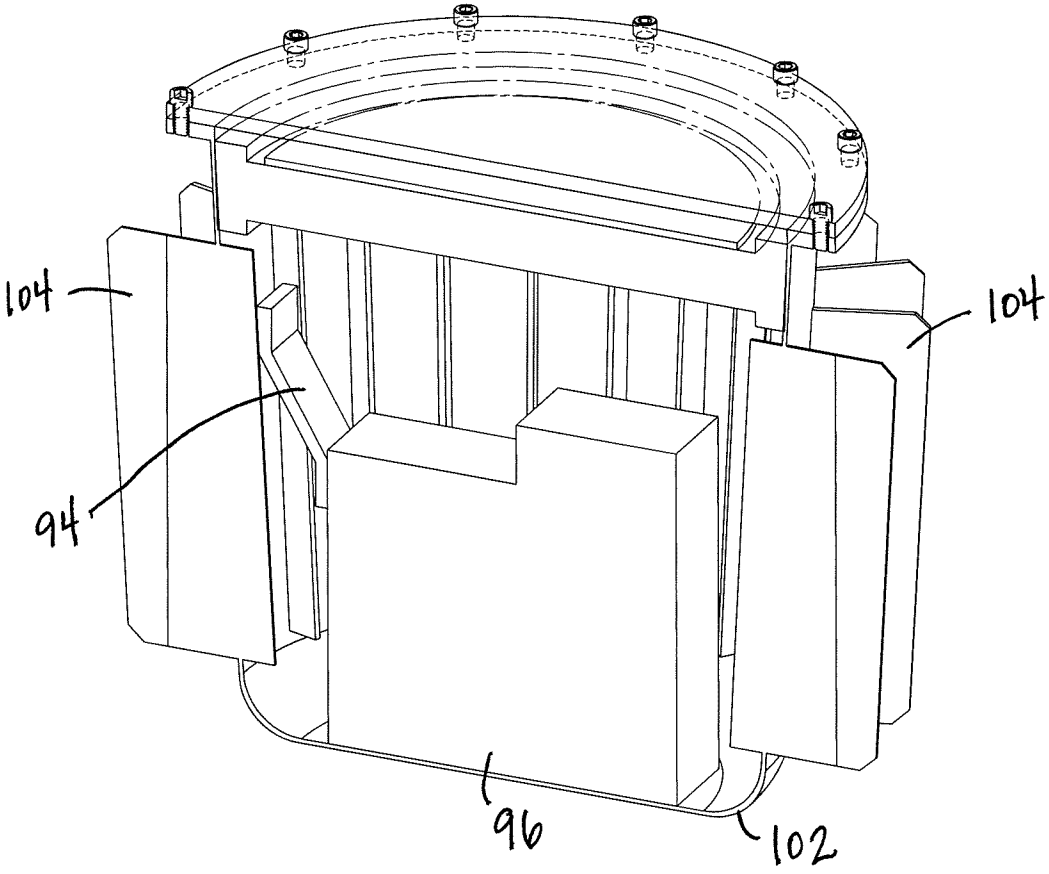
FIG. 13 is a cross section illustrating another embodiment for cooling the LED light fixtures of the present invention.

Alternatively, such heat pipes 103 could transfer the heat by penetrating the housing and extending directly into the water (FIG. 12). The heat would then be taken away from the pipes by convection in the water. Alternatively, such pipes could remain within the enclosure and transfer heat to a fin, or fins 104, that penetrate each side of the wall of the waterproof enclosure and deliver the heat to the water by convection (FIG. 13).

Figure 14:
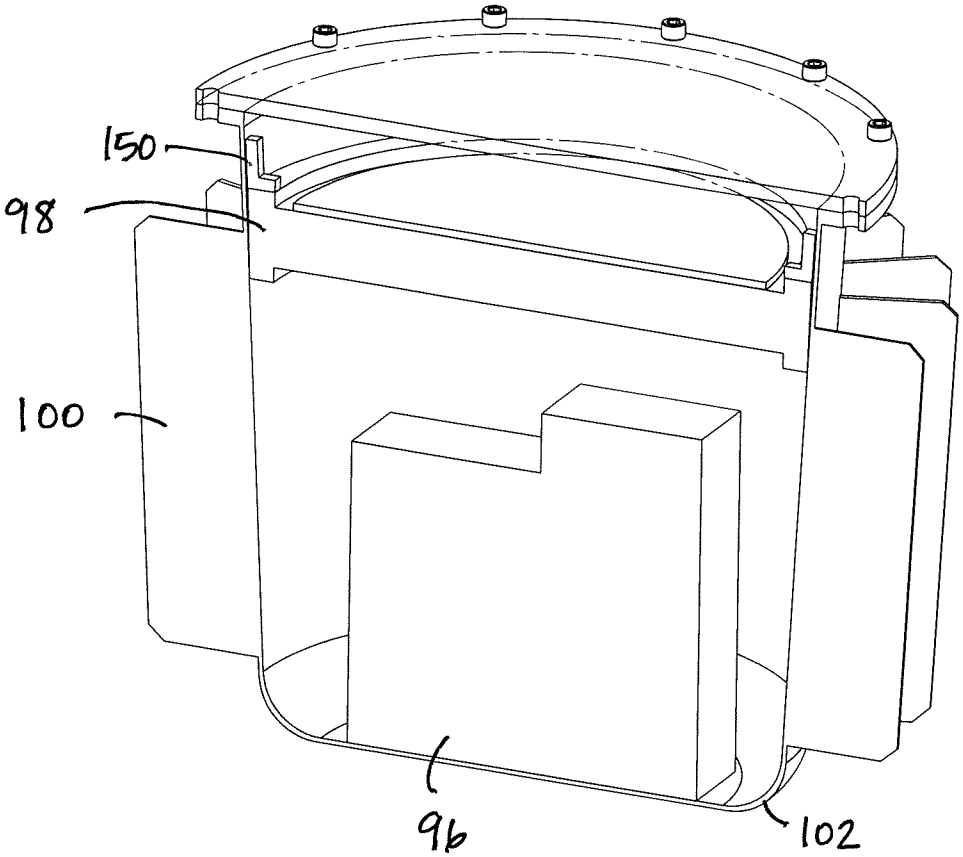
FIG. 14 is a cross section illustrating another embodiment for cooling the LED light fixtures of the present invention.

Now referring to FIG. 14, another embodiment using heat pipe pipes may be seen. This embodiment is similar to the embodiment of FIG. 11, though uses a heat pipe or heat pipes 150 to aide in the distribution of the LED heat from heat conductor 98 to the housing 102, and thus to the surrounding water. Because of the configuration shown, multiple heat pipes may be used, or a single annular heat pipe may be used. The annular heat pipe might be less extensive to manufacture, though would not work well unless the underwater light was point vertically upward to maintain the annular heat pipe horizontal. Multiple heat pipes would work well, even with an angular tilt of the underwater light to an angular extent dependent on the angular extent of each light pipe around the inside of the housing 102 and other heat pipe parameters.

Figure 15:
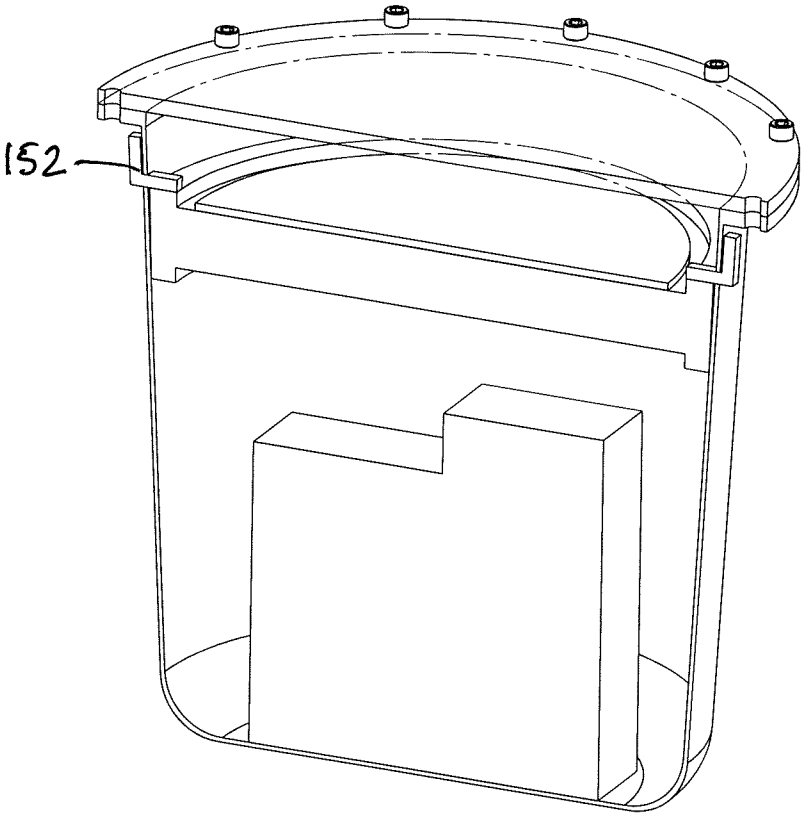
FIG. 15 is a cross section illustrating still another embodiment for cooling the LED light fixtures of the present invention.

FIG. 15 is similar to FIG. 14 in that it uses heat pipes 152 to couple LED heat from the heat conductor, though in this embodiment, directly to the water. Here a single heat pipe could not be used in the configuration shown, as a single heat pipe could not penetrate the housing as shown. As a further alternative however, a single annular heat pipe may be used as a local section or extension of the housing itself, subject however to the vertical limitation previously mentioned.

Figure 16:
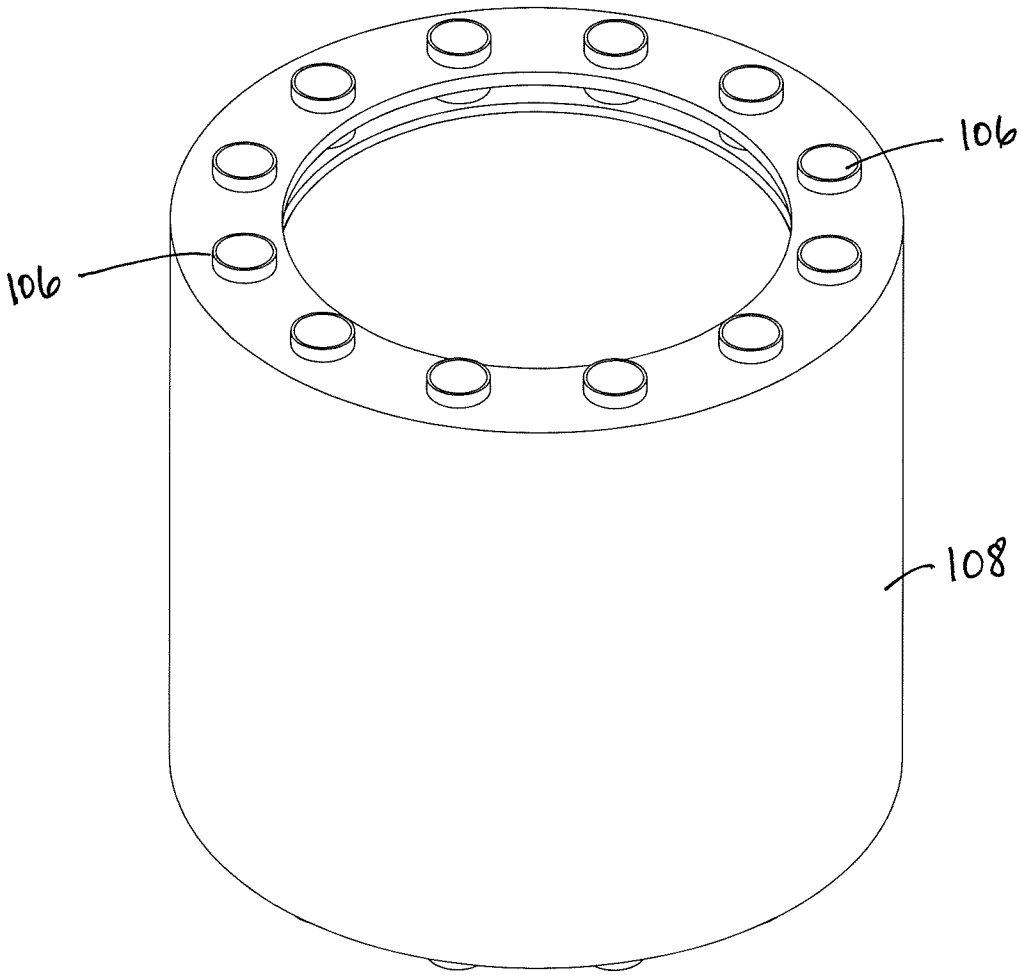
FIG. 16 illustrates another embodiment for cooling the LED light fixture of the present invention.
Figure 17:
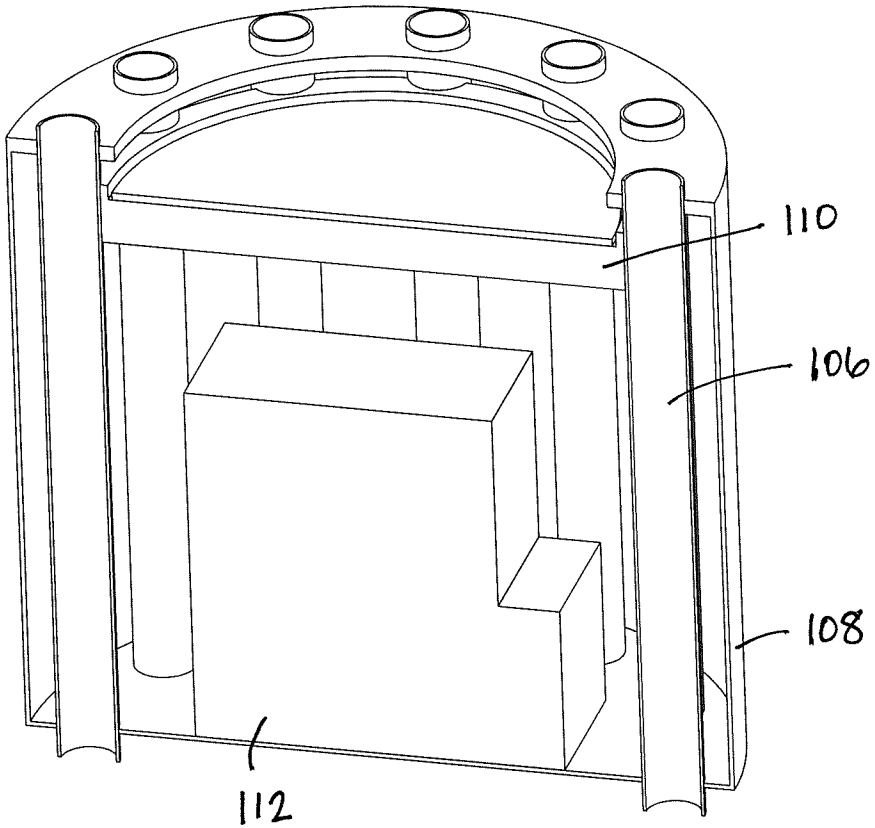
FIG. 17 is a cross section of the embodiment of FIG. 16.
Figure 18:
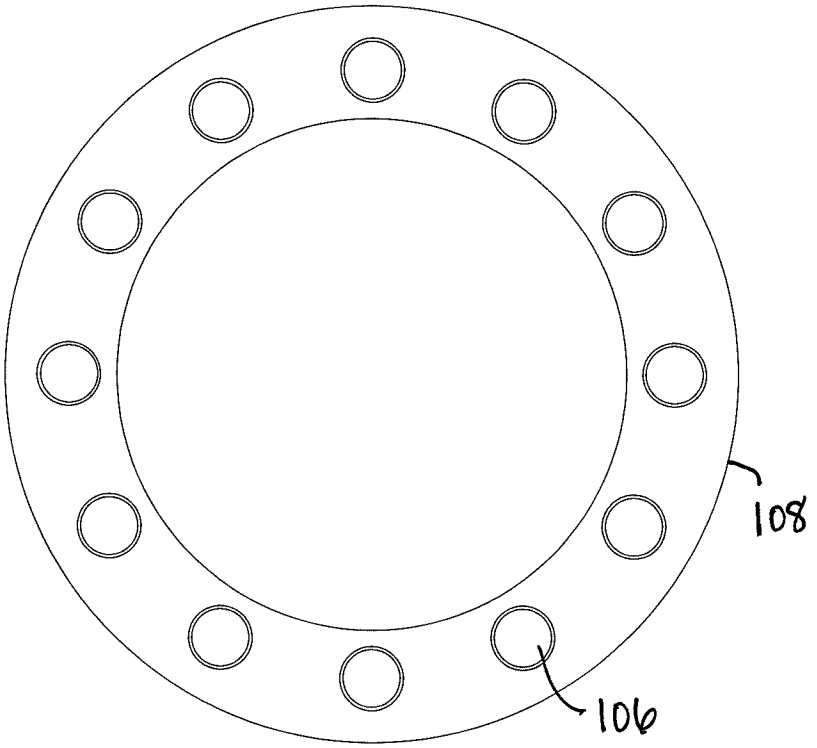
FIG. 18 is a top view of the embodiment of FIG. 16.

Also heat pipes 106 could be produced that carry water from outside of the waterproof enclosure 108 to the inside of the enclosure and back out again (FIGS. 16-18). Water, with or without a phase change, would move through the pipes by convection generated by the heat producing elements. As the water moved through the housing 108, it would gain heat from the heat producing elements, such as LED circuit boards on heat conductors 110, or power supplies 112, and then exit the waterproof enclosure, back into the greater body of water, at a higher level than it entered. Simultaneously cooler water would enter the pipe at the lower level. Such heat pipes could actually pass through the heat conductor 110 and/or the power supply 112, and serve to effectively increase the cooling area over that of a housing alone. By way of example, if the heat pipes are spaced one heat pipe inside diameter "D" apart (two diameters heat pipe center to center), each will have an inside circumference of $\pi D$ (just over 3D) or collectively, they will have an inside circumference of approximately three halves the circumference of the circle their centers are on. This together with the circumference of the housing itself provides an area exposed to the water of approaching 2.5 times that of the housing alone.

Figure 19:
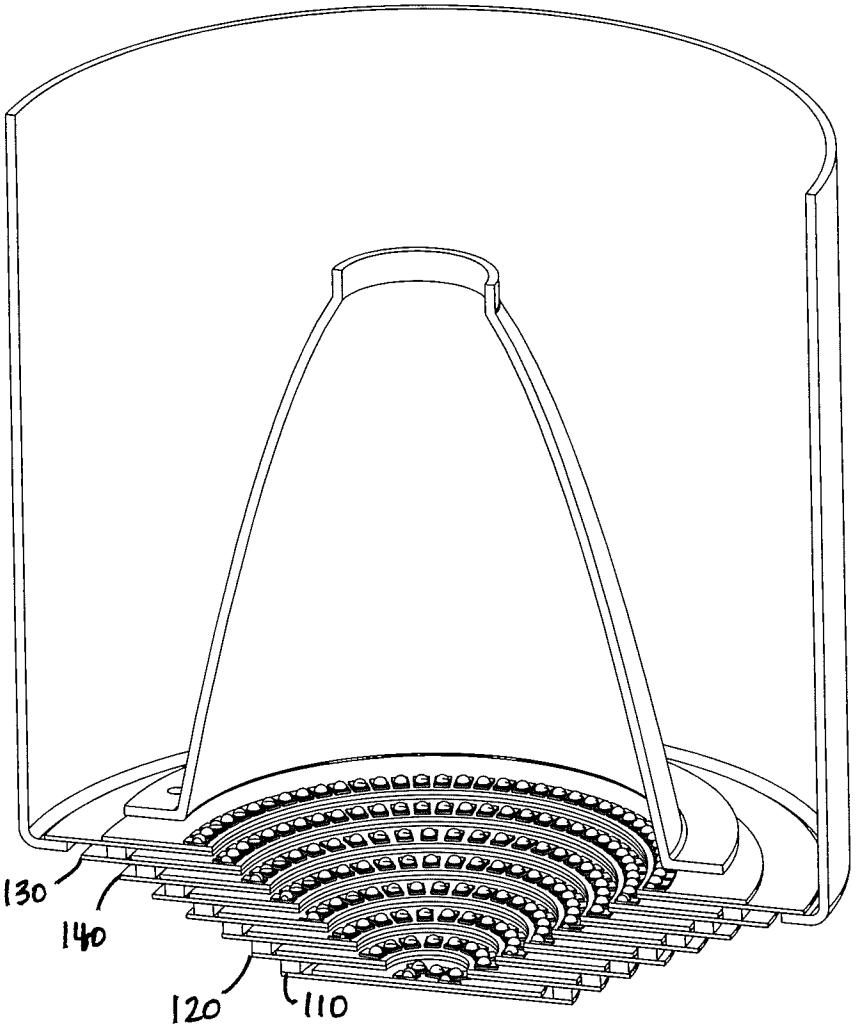
FIG. 19 illustrates another embodiment for cooling the LED light fixture of the present invention.

Also LEDs could be placed on circuit boards that were of good thermal conductivity, for example copper boards with the respective circuit connections and circuitry being to a printed circuit board locally mounted thereon. Such a configuration is well facilitated by some high power LEDs that have a thermal pad under the heat generating LED with the electrical connections somewhat displaced from the thermal pad. This enables the thermal pad to be mounted directly to the copper or other heat conductor, though such a configuration is not a limitation of the invention. This general configuration provides the following features, as illustrated in FIG. 19. These circuit boards 110, 120, etc. would have a larger footprint than the LEDs and attending circuitry placed on them. Then the portion, and only the portion, of the circuit boards containing the LEDs and attending circuitry, could be sealed in a waterproof medium, for example epoxy, to form part of the housing to allow the entire unit to be exposed to the water, as shown in FIG. 19. As the circuit boards would be larger than the electronics and LEDs placed on them, and since they would be of good thermal conductivity, this would allow significant and efficient heat transfer to the water from the non-sealed portion of the circuit board exposed to the water. Heat would travel efficiently to the non-sealed portion of the circuit boards by conduction and then into the water efficiently due to the non-sealed section of each circuit board being in contact with the water. In some cases such as boards 130 and 140, the boards may extend outward to the extent that both sides of the periphery of the boards are exposed to the water.

Figure 20:
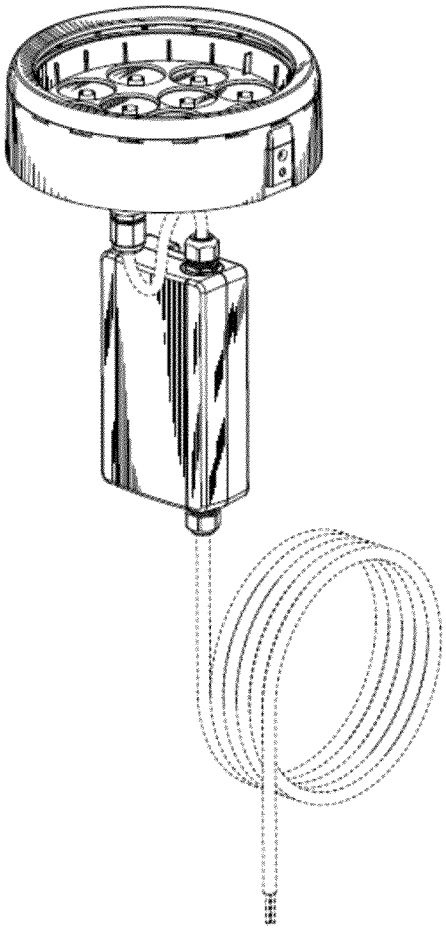
FIG. 20 illustrates another underwater LED lamp, which lamp uses 12 high power LEDS as the LED light sources.

FIG. 20 illustrates another underwater LED lamp 58, which lamp uses 12 high power LEDS as the light sources. The LEDs are arranged in an inner circle of 3 LEDs and an outer circle of 9 LEDs.

Figure 21:
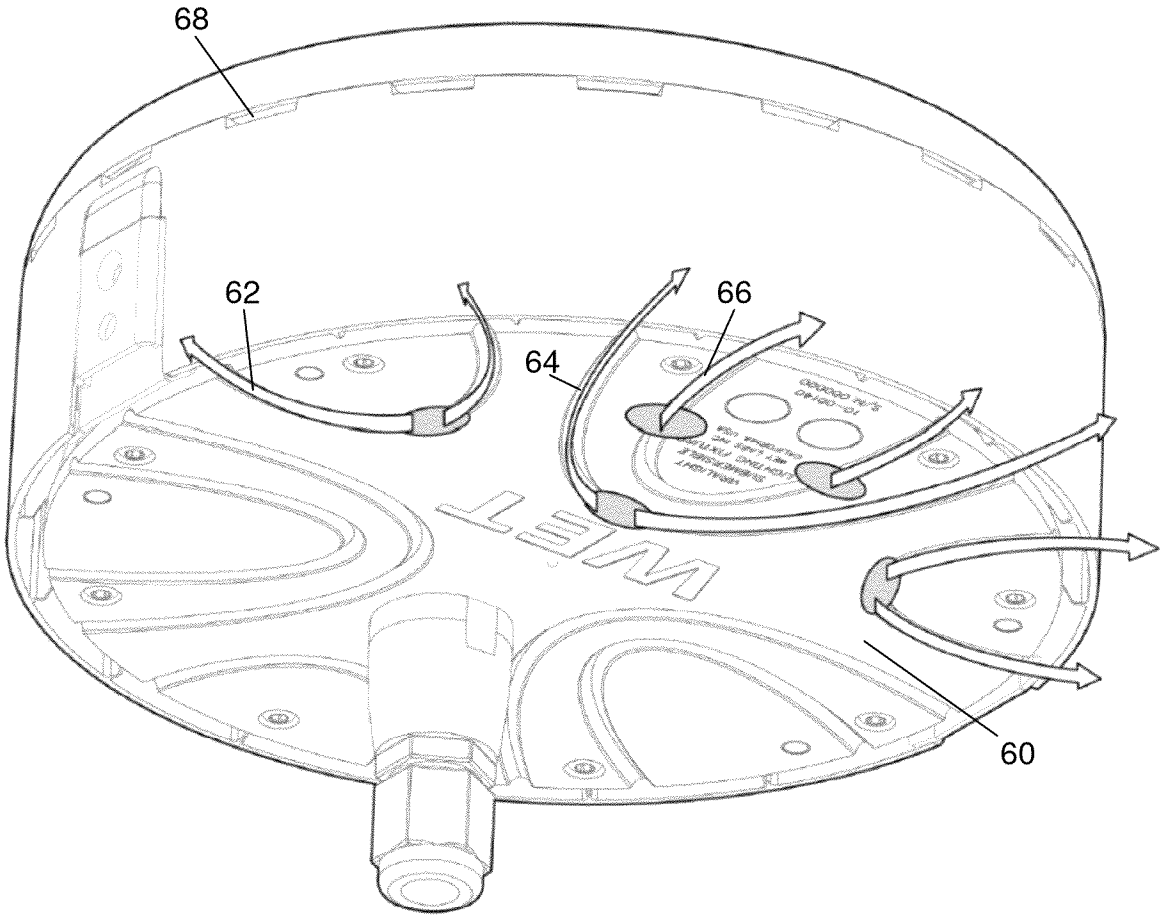
FIG. 21 illustrates the bottom of the lamp of FIG. 20.

FIG. 21 illustrates the bottom of the lamp of FIG. 20. A cooling fin or plate 60 has a number of "U" shaped grooves cut therein that run from the edge of the fin/plate 60 to just under the LEDs. These grooves are configured in the form of three single grooves 62 with three double grooves 64 and 66 interleaved therewith. The three grooves 62 extend inward to the outer circle of LEDs so as to be oriented just below a respective one of three of the LEDs in the outer circle of LEDs. Of the three pairs for grooves 64 and 66, grooves 64 extend inward to the inner circle of LEDs so as to be positioned just below a respective inner circle LED. The three grooves 66 extend inward to just under a respective pair of the remaining six LEDs in the outer circle of LEDs. The shaded areas shown in the Figure are meant to highlight some of the hot spots in on the fin/plate 60, and are not part of the physical structure.

Figure 22:
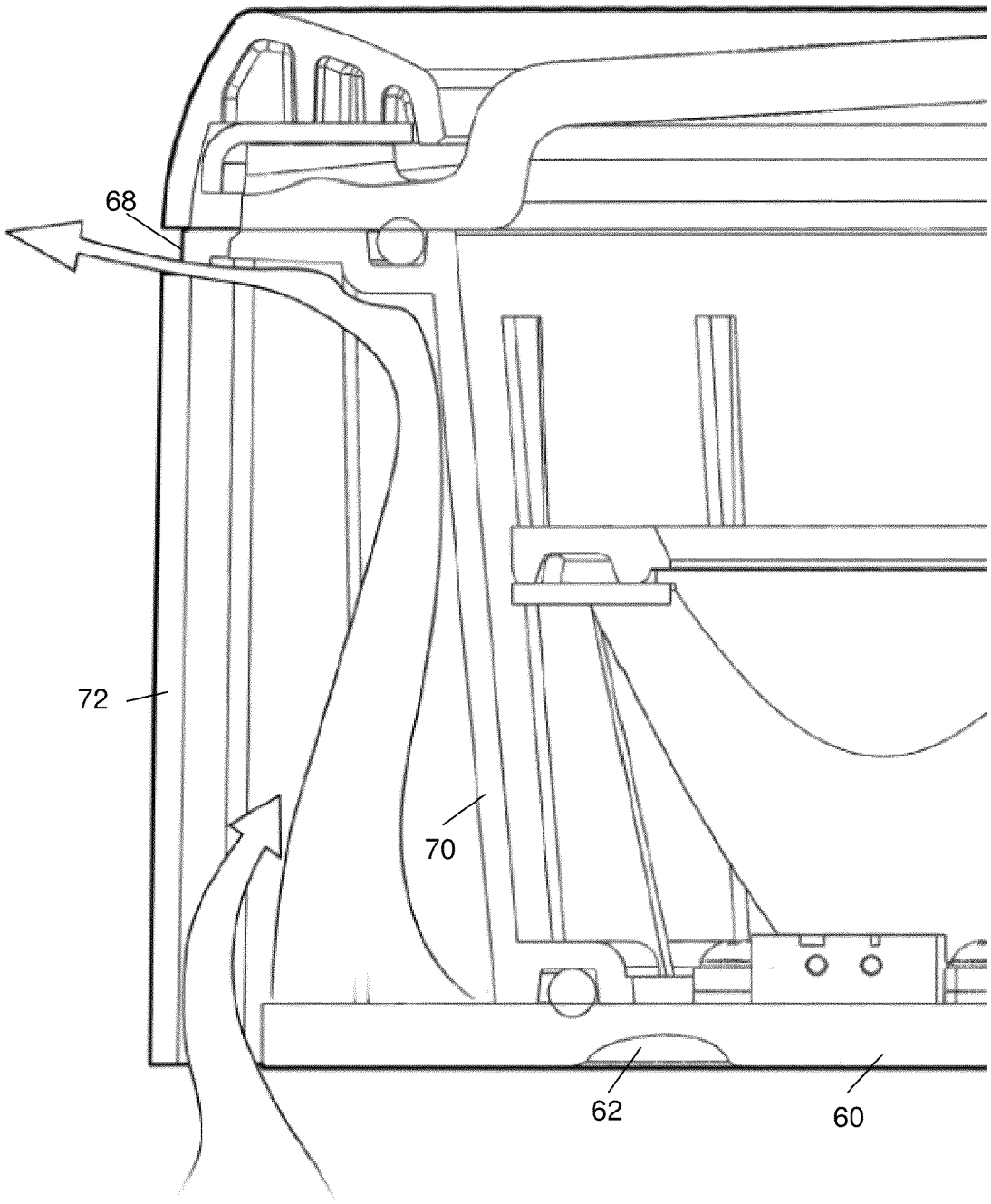
FIG. 22 is a half cross section of the entire lamp assembly of the embodiment of FIGS. 20 and 21.

FIG. 22 is a half cross section of the entire lamp assembly of this embodiment taken through opening 68, one of multiple such openings. Member 70 is sealed with respect to the top assembly and with respect to the cooling fin/plate 60 forming the base of the lamp assembly on which the LEDs are mounted. The cooling fin/plate 60 extends radially outward beyond the member 70, but not to the lamp outer casing 72, so as to form an entrance of cooling water between the outer diameter of the cooling fin/plate 60 and the inner diameter of the casing 72.

In operation, the heat given off by the high power LEDs on the top of cooling fin/plate 60 heat the cooling fin/plate 60 and the water particularly in the grooves 62, 64 and 66. The cooling fin/plate 60 conducts some of that heat to the outer ring thereof that is outside or beyond the casing 72, also heating the water beneath, over and beyond the cooling fin/plate. This heated water rises because of its drop in density, ultimately passing out to the openings 68 as a first cooling source. In addition, this flow of water lowers the pressure at the end of the grooves 62, 64 and 66, causing a flow of water out the end of the grooves, to be replaced by cooler water rising to maintain the grooves full of water. This then forms a second source of cooling, making the overall system quite efficient for the intended purpose. In essence the grooves provide both flow passages and short conduction paths to the water without thinning the overall cooling fin/plate, which thinning would reduce the radially outward conduction of the cooling fin/plate.

Thus an annular gap above the cooling fin/plate 60 helps to draw heated water up away from the fin/plate, and cooler water to come in from below. To achieve this, grooves 62, 64 and 66 are cut into the cooling fin/plate on the water-side. These grooves serve several purposes:

i) They pass underneath the base of each LED element where the temperature is highest and due to the reduced thickness of the plate's cross section there they allow quicker transfer of heat to the water-side of the plate where the heat can be removed by the water.

ii) They increase the surface area of the plate that is exposed to water, allowing more heat to be drawn away by the water.

iii) The grooves are cut such that they still allow very good lateral dispersion of the heat while providing thinner cross sections that allow heat to transfer from the inside of the light fixture to the water-side of the cooling fin/plate. This allows optimization of heat transfer by allowing good heat transfer from inside the fixture to the water-side while still allowing much better lateral transfer of heat to the rest of the fin/plate. A fin/plate that was simply thinner overall would have areas that did not add to cooling, as much of the fin/plate would not efficiently have heat transferred to it; namely those areas that are not directly, or close to directly, underneath an LED element. Similarly, a fin/plate that was thick overall would allow good lateral transfer of heat, but would be less efficient at getting the heat from the inside of the fixture to the water side of the fin/plate. The grooves optimize the transfer of heat by providing the best fit between transfer of heat laterally and from inside the fixture to the water-side of the fin/plate.

A water pump can be incorporated so as to continuously move cooler water across the fin/plate.

In a number of embodiments disclosed herein, the completer water proof enclosure is not illustrated, but only certain aspects are illustrated. In general such enclosures may be completed and sealed in any conventional manner, such as, but not limited to that illustrated with respect to FIGS. 1-4. In all cases, the majority of the heat given off by the LEDs is transferred to the housing of the underwater light by heat transfer techniques, other than by convection of the air or other gases within the enclosure, by direct heat conveyance to or through the light enclosure walls, providing conduction through a heat conductor preferably having a coefficient of heat transfer of at least 8 Btu/(ft.hr.° F.) such as stainless steel, and more preferably at least 110 Btu/(ft.hr.° F.) such as aluminum or still more preferably 220 Btu/(ft.hr.° F.) such as copper, or by or as augmented by heat pipes to the inside wall of the enclosure or through the wall of the enclosure to the water.

Thus the present invention has a number of aspects, which aspects may be practiced alone or in various combinations or sub-combinations, as desired. While a preferred embodiment of the present invention has been disclosed and described herein for purposes of illustration and not for purposes of limitation, it will be understood by those skilled in the art that various changes in form and detail may be made therein without departing from the spirit and scope of the invention.

What is claimed is:

1. An LED light for underwater use comprising:

an LED light assembly having a heat sink thermally accessible from the periphery of the assembly;

a plate coupled to the heat sink to conduct heat from the heat sink;

a housing having an open top and an outward extending flange at the open top thereof;

the LED light assembly being positioned in the housing with the plate fastened to the flange at the top of the housing and extending outward beyond most of the flange; and a lens;

at least one lens clamp holding the lens with respect to the plate;

the lens, plate and flange assembly being sealed, whereby any other openings in the housing may be sealed to provide the LED light for underwater use.

2. The LED light of claim 1 wherein the plate is coupled to the heat sink through a thermally conductive clamp clamped to the heat sink.

3. The LED light of claim 1 wherein the any other openings in the housing comprise an opening for a power supply connection.

4. An LED light for underwater use comprising:

a housing;

a plurality of LEDs within the housing, wherein the LEDs are mounted in the housing to transfer the majority of the heat from the LEDs to at least one of the housing and water surrounding the housing by other than convection within the housing; and a power supply in the housing and at least one heat pipe, wherein the heat from the power supply is transferred to an inside surface of the housing by the at least one heat pipe coupled between the power supply and the inside surface of the housing.

5. The LED light of claim 4 wherein the housing has vertical fins on the outside surface of the housing.

6. The LED light of claim 4, wherein the heat from the power supply is transferred to the water by the at least one heat pipe having a first end coupled to the power supply and a second end passing through a wall of the housing to transfer heat directly to the water.

7. The LED light of claim 6 wherein the housing has vertical fins on the outside surface of the housing.

8. The LED light of claim 4, wherein the LEDs are mounted on a bottom of the housing and wherein the bottom of the housing extends outward beyond sidewalls of the housing, the housing having a casing around the outside of the housing with at least one opening between the casing and the bottom of the housing and at least one opening adjacent the top of the casing whereby water may flow between the casing and the housing and over the top of at least a part of the bottom of the housing.

9. The LED light of claim 8 wherein a lower surface of the bottom of the housing has grooves therein, each groove extending from below at least one LED to the edge of the bottom of the housing to provide a water flow path from below each LED to an outer edge side of the bottom of the housing.

10. An LED light for underwater use comprising:

an LED light assembly having a heat sink thermally accessible from the periphery of the assembly;

a clamp coupled around the heat sink to conduct heat from the heat sink;

a plate coupled to the clamp to conduct heat from the clamp;

a housing having an open top and an outward extending flange at the open top thereof;

the LED light assembly and clamp being positioned in the housing with the plate fastened to the flange at the top of the housing and extending outward beyond most of the flange; and a lens;

at least one lens clamp holding the lens with respect to the plate;

the lens, plate and flange assembly being sealed, whereby any other openings in the housing may be sealed to provide the LED light for underwater use.

11. The LED light of claim 10 wherein the any other openings in the housing comprise an opening for a power supply connection.

12. An LED light for underwater use, comprising:

a housing and;

an LED cluster within the housing, wherein the LED cluster is mounted on and in close thermal contact with a heat conductor, and wherein the heat conductor is in close thermal contact with a first surface of a wall having water on a second surface of the wall opposite the first surface;

whereby when the housing is sealed and the LED light is operated under water, the majority of the cooling of the LED cluster is by conduction of the heat generated by the LED cluster to the inside surface of the housing and not by convection or radiation of heat to the inside surface of the housing;

wherein the wall forms part of a housing with at least one cooling fin on the outer surface of the housing and;

wherein the cooling fin is oriented perpendicular to the direction the LED light projects light; and wherein the cooling fin is an extension of the heat conductor.

13. The LED light of claim 1, wherein the plate comprises a ring.

14. The LED light of claim 13, wherein the ring comprises copper.

* * * * *